United States Patent [19]

Moser

[11] 4,172,526

[45] Oct. 30, 1979

[54] METHOD AND APPARATUS FOR SORTING CAPSULES

[75] Inventor: Theo Moser, Remseck, Fed. Rep. of Germany

[73] Assignee: Robert Bosch GmbH, Stuttgart, Fed. Rep. of Germany

[21] Appl. No.: 900,218

[22] Filed: Apr. 26, 1978

[30] Foreign Application Priority Data

Apr. 29, 1977 [DE] Fed. Rep. of Germany ..... 2719142

[51] Int. Cl.[2] ..... B67C 5/06

[52] U.S. Cl. ..... 209/625; 209/644; 209/659

[58] Field of Search ..... 209/625, 644, 659

[56] References Cited

U.S. PATENT DOCUMENTS

| | | | |
|---|---|---|---|
| 3,351,197 | 11/1967 | Smith | 209/644 X |
| 3,385,433 | 5/1968 | Grimaldi et al. | 209/625 X |
| 3,537,579 | 11/1970 | Roberson | 209/625 X |
| 3,625,357 | 12/1971 | Ochs | 209/625 |
| 3,785,487 | 1/1974 | Spencer | 209/625 X |

*Primary Examiner*—Allen N. Knowles
*Attorney, Agent, or Firm*—Edwin E. Greigg

[57] ABSTRACT

Defective and/or deformed capsules, for example, hard gelatin capsules, are identified and removed from a supply of such capsules by causing the ordered, sequential transport of capsules through a dimensionally calibrated passage in which a defective capsule is arrested while the preceding train of capsules is permitted to continue. The gap in the train of capsules is detected by a photoelectric sensor or the like, after which the machine member in which the calibrated passage is located is moved to the vicinity of a reject container, compressed air is admitted to the passage and the defective capsule is expelled into the reject container. The application of the compressed air and the movement of the machine member to the reject container may be under the control of the photoelectric sensor signal.

6 Claims, 1 Drawing Figure

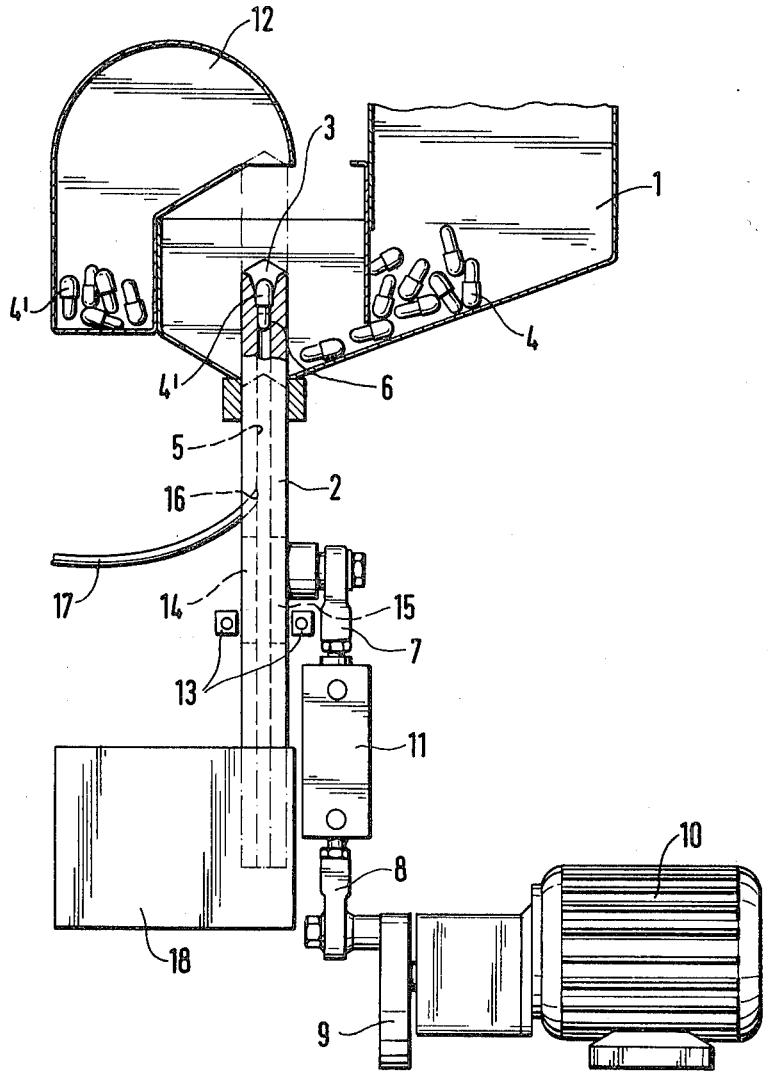
12
3
1
4'
4
4'
6
5
16
2
17
14
15
7
13
11
10
8
18
9

METHOD AND APPARATUS FOR SORTING CAPSULES

BACKGROUND OF THE INVENTION

The invention relates to a method and an apparatus for the automatic sorting of capsules, for example gelatin capsules used in the packaging of pharmaceutical products and the like. More particularly, the invention relates to a method and an apparatus for eliminating from a supply of capsules any which are dimensionally sub-standard, i.e. do not conform to the dimensional specifications, in particular with respect to the diameter. The sorting takes place at the point where a random supply of capsules is transformed into an ordered, sequential stream.

During the processing of capsules, for example hard gelatin capsules, either separately or in machinery which fills the capsules with some product and closes them thereafter, difficulties often arise in the supply of the capsules due to the fact that damaged or deformed capsules jam up the supply conduits. While the supply of capsules is subjected to a visual control prior to being placed in the storage container, damaged capsules nevertheless often escape detection by this visual control. Prior to being used by filling machinery and the like, the capsules must be placed into a sequential stream which is then transported to the processing stations through one or more conduits. If any of the capsules is deformed or oversized, such a capsule will hang up or jam in one of the channels. The removal of such a capsule entails a substantial expenditure of time and labor because it is usually not immediately obvious which of the capsules is damaged and has caused the stoppage. Moreover, the machinery is usually provided with several protective and safety devices which must first be removed in order to gain access to the conveyor tubes. Once the damaged or defective gelatin capsule is found, it must be removed by hand after which the safety devices must be reinstalled and only then can the machine be restarted. The extensive down-time and the expenditure of labor which this method entails is not economically feasible. Furthermore, the productivity of the machine is substantially reduced by its stoppage during the time required for removal of the defective capsules.

OBJECT AND SUMMARY OF THE INVENTION

It is thus a principal object of the present invention to describe a method and provide an apparatus for the automatic detection and elimination of defective gelatin capsules from an apparatus which selects them prior to being filled or processed.

It is a further object of the invention to provide for automatic elimination of defective capsules rapidly and reliably. These and other objects are attained according to the invention by permitting the transport of capsules ahead of the defective capsules, thereby defining the location and identity of the defective jammed capsule. After identification, the offending capsule is removed from the stream and the automatic transport is reinitiated.

The defective capsule, which may be damaged or oversized or otherwise dimensionally defective, is held back by a deliberate narrowing of the supply channel and is advantageously removed by the application of compressed air.

Advantageously, the absence of transported capsules is detected by photoelectric methods.

The invention will be better understood, as well as further objects and advantages thereof become more apparent from the ensuing detailed description of a preferred embodiment taken in conjunction with the drawing.

BRIEF DESCRIPTION OF THE DRAWING

The single FIGURE of the drawing is a partially sectional front elevational view of an apparatus for carrying out the method according to the invention.

DESCRIPTION OF THE PREFERRED EMBODIMENT

Turning now to the single FIGURE of the drawing, which is shown in vertical section, there will be observed a storage container 1 containing a quantity of capsules, for example hard gelatin capsules used to package pharmaceutical products and the like. An opening at the bottom of the supply container supplies capsules to a chute in contact with a vertically reciprocating supply tube 2 which has an opening 3 for receiving individual ones of the capsules 4 when suitably positioned. Communicating with the opening 3 in the tube 2 is an axial bore 5 through which the capsules 4 pass and from which they are finally delivered to a processing station generally indicated by the box 18. The box 18 may also designate a container in which sorted capsules are collected for further processing by separate machines. In a region 6 immediately adjacent the opening 3, the bore 5 has a calibrated narrowed diameter permitting only correctly dimensioned gelatin capsules 4 to continue farther down the tube. Damaged and deformed capsules 4', however, will fail to pass this narrowed cross section 6 and will be halted at that point. The supply tube 2 is vertically reciprocated by means of levers 7 and 8 driven by a crank 9 which is powered by a motor 10. Connected between the levers 7 and 8 is a pneumatic cylinder assembly 11 which can be extended axially under the influence of compressed air, thereby causing a relative extension of the distance between the levers 7 and 8 and thus causing an additional vertical displacement of the supply tube 2. When subjected to this additional vertical displacement, the opening 3 of the supply tube 2 reaches a position indicated in dash-dotted lines which communicates with a container 12 intended to hold defective capsules 4'. The transmission and continued presence of capsules 4 within the bore 5 is monitored by a photoelectric device 13. Transparent portions 14 and 15 in the tube 2 permit the passage of light from one element to the other of the device 13, thereby indicating the presence or absence of capsules 4. The bore 5 communicates through a line 17 with a source of compressed air, not shown, and capable of actuation by the photoelectric device 13. Similarly, the pneumatic cylinder 11 can be actuated by, for example, solenoid valves under the control of the photoelectric device 13.

The apparatus described above functions as follows:

The vertical reciprocating motion of the supply tube 2 causes the periodic pickup of capsules 4 from the supply container 1 and if these capsules 4 are of the correct size and are undeformed, they pass through the channel 5 until they emerge from the tube 2 and enter the processing station or container 18. The presence of a train of capsules in the bore 5 is monitored by the photoelectric device 13. If a defective or deformed capsule 4' enters the opening 3 and fails to pass the narrowed diameter 6, the further supply of capsules 4 is interrupted so that the bore 5 of the tube 2 is rapidly emptied. As soon as the capsules 4 have left the active region of the photoelectric device 13, the latter generates an electrical signal which is applied to actuators, not shown, which cause an actuation of the pneumatic cylinder 11. The actuation means may be, for example, a solenoid valve which is actuated by the suitably amplified signal from the device 13 and which permits the passage of compressed air to the cylinder 11. As a consequence of the admission of compressed air to the cylinder 11, the latter extends and causes the upward motion of the supply tube to assume the position shown in dash-dotted lines in which the opening 3 communicates with the storage container 12. At the same time, the signal from the photoelectric device 13 causes a short term application of compressed air to the connection line 17, for example by means similar to those described above for the cylinder 11, thus propelling the jammed and defective capsule 4' from its position in the opening 3 and into the storage container 12. The appropriate pneumatic actuation of the cylinder 11 then causes the return of the supply tube 2 into its normal position in which the reciprocation imparted by the crank 9 permits the previously described sequential supply of capsules 4 through the bore 5.

The method and apparatus described above, i.e. the automatic identification and elimination of defective capsules take the place of the previously customary sorting by hand and eliminate the loss of production due to the shut-down of the machine for the purpose of finding and eliminating defective capsules.

As already indicated above, the method and apparatus according to the invention may also be used for the purpose of sorting out defective capsules independently of further processing machinery, in which case the element 18 would be a storage container for sorted capsules.

The foregoing relates to a preferred exemplary embodiment of the invention, it being understood that other embodiments and variants thereof are possible within the spirit and scope of the invention.

What is claimed and desired to be secured by Letters Patent of the U.S. is:

1. An apparatus for sorting capsules by removing defective capsules from an unordered plurality of capsules comprising:

a supply container for holding a plurality of unsorted capsules;

movable transport means for receiving individual capsules seriatim from said supply container, said movable transport means including a conduit therein, a portion of which is so dimensioned that defective ones of said capsules are retained thereby while normal capsules are able to traverse said conduit; and means for removing a retained one of said defective capsules from said transport means.

2. An apparatus as defined by claim 1, wherein said conduit includes an inlet orifice and a subsequent channel portion and said dimensioned portion of said conduit is a section having a calibrated internal diameter.

3. An apparatus as defined by claim 2, further comprising a detector for detecting the presence and absence of capsules in said channel portion of said conduit.

4. An apparatus as defined by claim 3, wherein said detector is a photoelectric detector including means for sending the passage of light through said conduit and wherein said means for removing a defective capsule includes a source of pneumatic pressure connected to said conduit.

5. An apparatus as defined by claim 1, further comprising means for imparting a reciprocating motion to said transport means to periodically approach said supply container to pick up one of said capsules, and secondary extension means, coupled to said transport means for providing motion thereof extending beyond said reciprocating motion so as to place said transport means into a suitable position for expulsion of one of said defective capsules.

6. An apparatus as defined by claim 5, further comprising a detector for detecting the presence and absence of capsules in said conduit, and wherein said means for removing a retained one of said defective capsules includes a source of pneumatic pressure, coupled to said conduit and to said secondary extension means, for selective admission of compressed air thereto under the control of signals from said detector.

* * * * *